US008959844B2

(12) United States Patent
Ingalls

(10) Patent No.: US 8,959,844 B2
(45) Date of Patent: Feb. 24, 2015

(54) CANTILEVERED STRUCTURE

(76) Inventor: Mike Ingalls, Mayer, MN (US)

( * ) Notice: Subject to any disclaimer, the term of this patent is extended or adjusted under 35 U.S.C. 154(b) by 220 days.

(21) Appl. No.: 13/071,696

(22) Filed: Mar. 25, 2011

(65) Prior Publication Data

US 2012/0240481 A1 Sep. 27, 2012

(51) Int. Cl.

| | |
|---|---|
| ***E04B 1/34*** | (2006.01) |
| ***E04B 7/04*** | (2006.01) |
| ***E04H 1/00*** | (2006.01) |
| ***E04B 1/00*** | (2006.01) |
| ***E04B 9/00*** | (2006.01) |
| ***E04C 2/34*** | (2006.01) |
| ***E02D 27/32*** | (2006.01) |
| ***E04H 12/00*** | (2006.01) |
| ***E04B 1/38*** | (2006.01) |

(52) U.S. Cl.

CPC ..... *E04B 1/003* (2013.01)
USPC ..... 52/73; 52/650.3; 52/702; 52/79.6; 52/93.1; 52/93.2; 52/289; 52/480; 52/481.1; 52/294

(58) Field of Classification Search

USPC ..... 52/73, 650.3, 702, 79.6, 93.1, 93.2, 52/283, 294–297, 289, 480, 481.1, 222, 52/74, 96, 17

See application file for complete search history.

(56) References Cited

U.S. PATENT DOCUMENTS

| | | | | | |
|---|---|---|---|---|---|
| 3,242,620 | A * | 3/1966 | Kaiser | 52/73 |
| 3,423,898 | A * | 1/1969 | Coloney et al. | 52/713 |
| 3,495,371 | A * | 2/1970 | Mitchell, Jr. | 52/653.1 |
| 3,948,008 | A * | 4/1976 | Goetz | 52/73 |
| 4,796,391 | A * | 1/1989 | Lu | 52/73 |
| 5,193,324 | A * | 3/1993 | Fellows | 52/742.14 |
| 5,836,132 | A * | 11/1998 | Weathersby | 52/702 |
| 7,900,417 | B1 * | 3/2011 | Leines | 52/650.3 |
| 2002/0095892 | A1 * | 7/2002 | Johnson | 52/295 |
| 2005/0028469 | A1 * | 2/2005 | Grohman | 52/480 |
| 2006/0127181 | A1 * | 6/2006 | DelZotto | 405/4 |
| 2008/0116012 | A1 * | 5/2008 | Ferguson | 187/213 |
| 2009/0223164 | A1 * | 9/2009 | Cook et al. | 52/651.07 |
| 2010/0132292 | A1 * | 6/2010 | Gullette | 52/378 |
| 2012/0222385 | A1 * | 9/2012 | Matthews | 52/749.1 |

* cited by examiner

*Primary Examiner* — Phi A
*Assistant Examiner* — Omar Hijaz

(57) ABSTRACT

A deck for positioning adjacent a structure may include a foundation configured for positioning relatively proximate to the structure, a frame extending from the foundation, and a deck system arranged about and supported by the frame, wherein the deck is adapted for positioning adjacent the structure and for cantilevering away from the structure.

20 Claims, 7 Drawing Sheets

CANTILEVERED STRUCTURE

FIELD OF THE DISCLOSURE

The present disclosure relates generally to decks, balconies, perches, and other platforms. More particularly, the present disclosure relates to cantilevered elevated platforms and still more particularly, the present disclosure relates to free-standing cantilevered elevated platforms.

BACKGROUND

Residential deck structures often form an integral part of the architectural façade of a home. Common residential deck construction often includes a ledger board secured to an exterior surface of a home, a beam spaced apart from the home and supported by columns, and joists spanning between the ledger board and the beam. Deck boards are then placed on the joists to provide a deck surface. Railing systems may also be provided around the perimeter of the deck.

This type of deck construction requires that the ledger board be attached to the home at the time of original construction or that the siding be cut away at a later time to install the ledger board. In recent years, there have been a large amount of deck failures resulting from deterioration in and around the deck ledger board due to moisture intrusion. This type of deck construction can also obstruct the use of space beneath the deck due to the mentioned columns that are spaced apart from the home for supporting the beam. Still further, the conventional nature of this type of construction may not be appealing to homeowners or architects looking to add architectural attractiveness or make an architectural statement.

SUMMARY

In one embodiment, a deck for positioning adjacent a structure may include a foundation configured for positioning relatively proximate to the structure, a frame extending from the foundation, and a deck system arranged about and supported by the frame, wherein the deck is adapted for positioning adjacent the structure and for cantilevering away from the structure. The anti-gravity appearance of the deck may thus be attractive or noteworthy and add to the architectural appeal of the deck and surrounding structure. Moreover, the self-supporting nature of the deck may help to avoid the moisture intrusion issues associated with ledger board-type decks. Still further, the cantilevered nature of the deck may avoid the need for columns that may obstruct the space beneath the deck.

In another embodiment, a deck for support by a foundation may include a residential deck system including a plurality of wood joists supported by a rim joist and decking arranged on the plurality of joists providing a deck surface. the deck may also include a means for cantilevered support of the residential deck relative to the foundation.

In still other embodiments, a deck for support by a foundation may include a cantilever frame extending from the foundation and configured for a moment resisting connection to the foundation. The frame may include an offsetting portion and an outlooking portion and may have a moment resisting connection between the offsetting and outlooking portions. The deck may also include a residential deck system arranged about and supported by the frame. The residential deck system may include a rim joist, a plurality of floor joists, and decking arranged on and supported by the plurality of floor joists.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION OF THE EMBODIMENTS

The present disclosure relates generally to decks, balconies, perches, and other platforms. More particularly, in one embodiment, the present disclosure relates to a free-standing cantilevered deck adapted for placement adjacent to a structure for cantilevering away from the structure and to appear as though the deck is cantilevered from the structure. That is, the deck may not include supporting columns under the side of the deck opposite the home or other structure. The deck disclosed herein may be constructed during the original construction process of a home or other structure or the deck may be constructed at some time thereafter. In either case, the free-standing nature of the deck may allow the deck to avoid moisture issues currently affecting many decks across our country and the world. The cantilevered aspect of the deck may provide for more free use of the space beneath the deck and may also add to the architectural appeal of the deck and the home as a whole.

Figure 1:
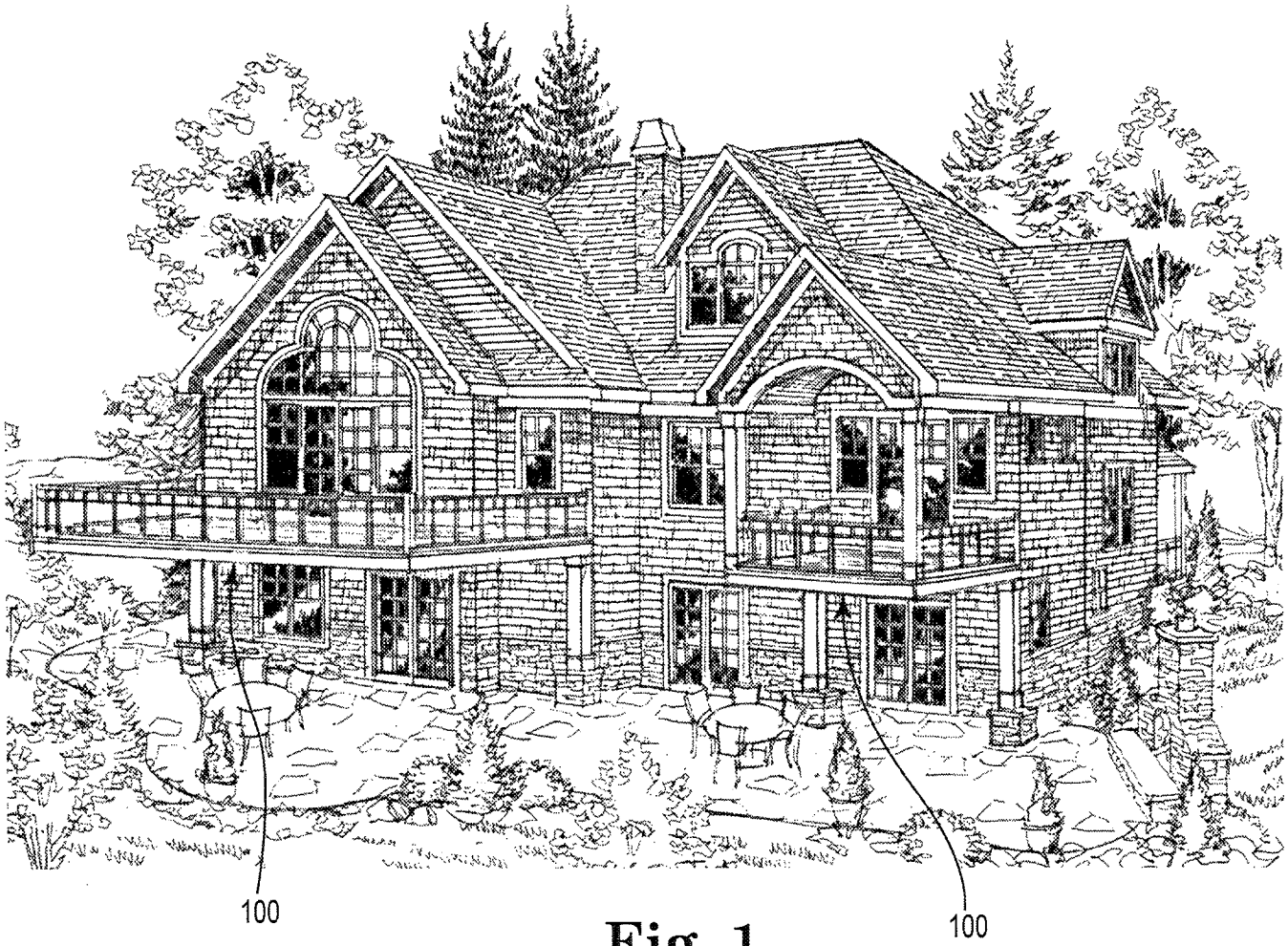
FIG. 1 is a perspective view of two decks adjacent to a residence according to certain embodiments.

Referring now to FIG. 1, one embodiment of a platform is shown in the form of a pair of residential decks adjacent a residential home structure. It should be appreciated that the deck may be placed away from a structure, adjacent other residential structures, or adjacent commercial or other types of structures. The decks shown depict at least two variations of the type of use that may be implemented on the surface of the deck. That is, as shown on the left deck, a relatively common type of use is provided where the surface of the deck is left relatively open for positioning of tables, chairs, or for allowing people to congregate or gather in the open space. On the right portion of the deck shown, the deck is covered with a roof supported from the deck by columns. Other adaptations of the deck surface may include screened-in porches, or three or four season porches. Other adaptations may also be provided. In some embodiments, joints may be provided between the deck, or portions thereof, and an adjacent structure for allowing differential movement of the deck relative to the adjacent structure. As such, where roofs are supported by the deck, the roof may include a joint positioned between the portion of the roof above the deck and the roof above the adjacent structure, for example. In other embodiments, the deck may be pre-loaded to cause dead load deflections to be induced in the structure prior to construction of the roof or other dead load causing elements. As such, the deflections seen by the deck throughout the life of the structure may be limited to live loads allowing joints to be reduced in size or avoided all together.

Figure 2:
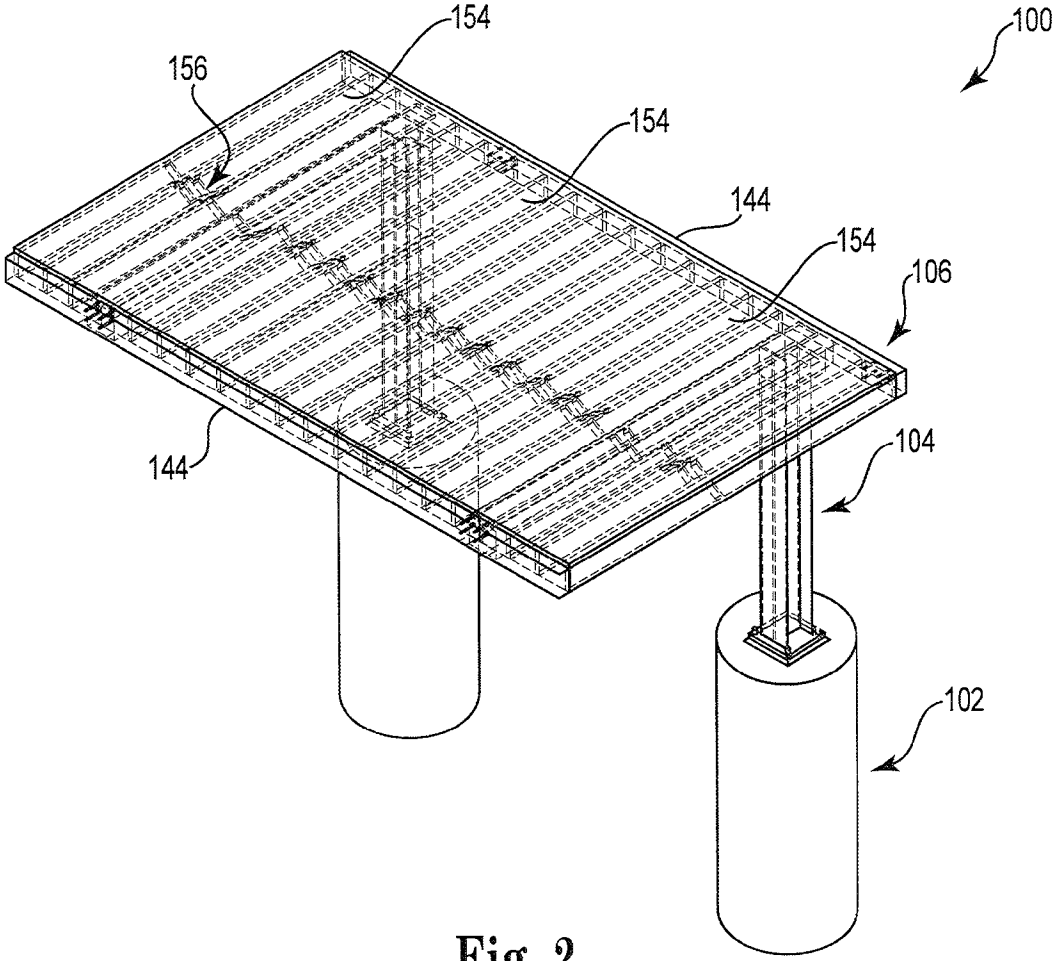
FIG. 2 is a perspective view of a deck according to certain embodiments.

Referring now to FIG. 2, the deck 100, in one embodiment, may include a foundation 102 configured for supporting and anchoring the deck 100. The deck 100 may also include a frame or frames 104 extending from the foundation 102 and a deck system 106. The frame 104 may be configured for collecting the loads from the deck system 106 and transferring the loads to the foundation 102. The deck system 106 may include a deck surface and supporting elements configured for supporting deck loads and transferring the loads to the frame 104.

Figures 4, 5:
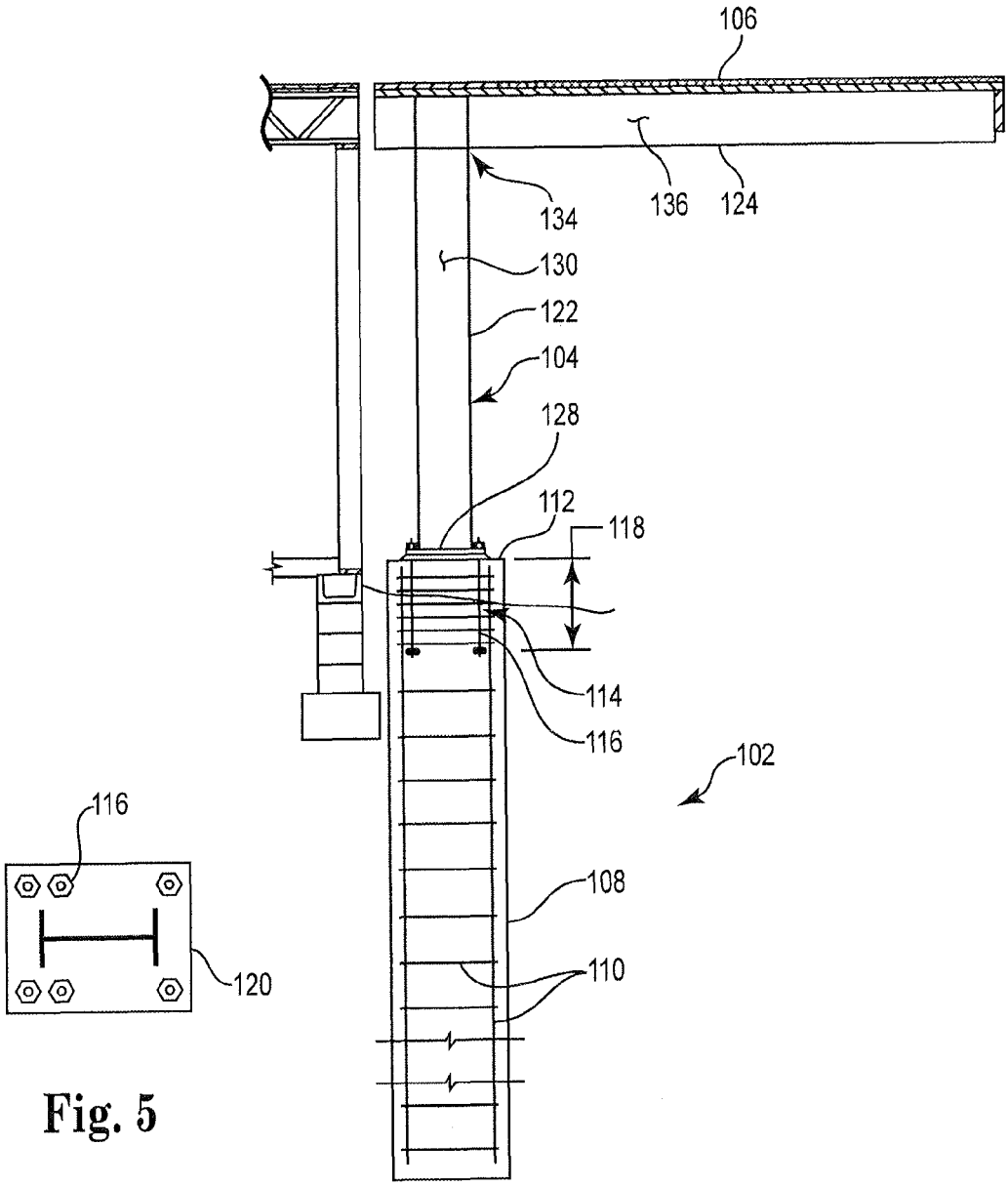
FIG. 4 is a cross-section view through a foundation, frame, and deck system of the deck of FIG. 2.
FIG. 5 is a top view of a base plate according to certain embodiments.

Beginning with the foundation 102, in one embodiment, as shown in FIG. 4, a caisson foundation may be provided. A caisson 108 may be provided for each respective frame 104 of the deck 100 and may be configured to support the gravitational vertical and overturning loads imparted thereon by the frame 104. The caisson 108 may also be configured for resisting shear forces imparted thereon due to vibration or motion on the surface of the deck 100 in addition to wind loads and seismic loads. Other loads imparted on the superstructure (e.g., the frame 104 and deck system 106) of the deck 100 may be resisted by the caisson foundation 108.

The caisson foundation 108 may include a vertically extending pier positioned in the ground. The pier may have a cylindrical cross-section or another cross-section may be provided. For example, square, rectangular, or other shapes may be used. The vertically extending pier may include concrete made from cement, water, aggregates, and one or more admixtures. Other ingredients may also be provided and selected for a suitable foundation 102. For example, in some embodiments, fly ash may be included. The aggregates may include sand and larger aggregates such as ½", ¾", 1", or larger aggregates. Other sizes of aggregate may also be used. The cement may include a portland cement or other suitable cementitious material. The water/cement ratio of the concrete may range from approximately 0.1 to approximately 0.7 or it may range from approximately 0.25 to approximately 0.65. In still other embodiments, the water/cement ratio may range from approximately 0.3 to 0.45. Other water/cement ratios may also be provided. The admixtures may include air entrainment, accelerators, retarders, plasticizers, or superplasticizers. Other admixtures may also be provided and selected to provide a suitable foundation 102 for the deck 100. The concrete may have a 28-day compressive strength ranging from approximately 500 psi to approximately 8000 psi. In other embodiments, the compressive strength may range from approximately 2000 psi to 5000 psi. In still other embodiments, the compressive strength may be approximately 3000 psi. The caisson 108 may also be made from other materials other than concrete.

The caisson 108 may also include reinforcing 110 arranged to resist the loads induced on the caisson 108. These loads may include loads induced on the caisson 108 from the deck superstructure and may also include other loads on the caisson 108 such as temperature change forces and shrinkage forces. In particular, the caisson cross-section and associated reinforcing 110 may be designed to carry the weight of the deck dead load and live load in addition to the bending moments induced therein due to the cantilevered nature of the deck 100. In some embodiments, the reinforcing 110 may be steel reinforcing such as ASTM Grade 40 or 60 reinforcing. Other grades of steel reinforcing or other materials for reinforcing may also be used. In some embodiments, the caisson 108 may be reinforced with a fiber mesh reinforcing in addition to the steel reinforcing or in place thereof. Where steel reinforcing or other longitudinal bar type reinforcing is used, the reinforcing may be arranged longitudinally along the length of the caisson 108 in a rectangular array, a radial array, or another arrangement. Where a radial array is provided, one or more concentric arrays of reinforcing 110 may be provided, for example. The reinforcing 110 may also include circumferentially arranged hoops or ties. In other embodiments, straight ties may be used that extend across the array of longitudinal reinforcing. The longitudinal reinforcing together with the hoops or ties may be referred to herein as a reinforcing cage. In some embodiments, multiple cages may be provided and may be concentrically arranged about a longitudinally extending axis of the caisson 108. In some embodiments, the cross-sectional area of reinforcing 110 may be concentrated more in one portion of the cross-section of the caisson 108 than in other portions of the cross-section to accommodate the bending forces. For example, the reinforcing 110 positioned near the face of the caisson 108 opposite the direction of the cantilevered deck may include a larger area than the reinforcing 110 on the face toward the cantilevered deck. In other embodiments, reinforcing 110 may be provided on one side of the cross-section and not the other. For example, longitudinal reinforcing may be provided on the face opposite the cantilevered direction and no longitudinal reinforcing may be provided on the other face. Other arrangements of reinforcing 110 may be also be provided.

In one embodiment, as shown, the caisson 108 may include a 30 inch diameter caisson that extends 17'-0" into the ground and extends 6 inches above the ground. A 30 inch hole may be drilled into the ground and a casing may be provided depending on the cohesiveness of the soils. In some embodiments, depending on the soil capacity and other factors, the caisson 108 may include a belled bottom. The 30 inch diameter caisson 108 may include six #6 vertical bars extending the longitudinal length of the caisson 108 or pier. Each bar may extend the full length or several bars may be provided and lapped a distance as specified by the American Concrete Institute (ACI). Other lap lengths may also be provided or selected for a suitable foundation. As shown, the caisson 108 may also include #3 ties at 12 inches on center throughout the length of the caisson 108 in addition to a more concentrated set of six #3 ties near the top of the caisson 108 at 4 inches on center. Other sizes of caissons 108 and arrangements of reinforcing 110 may also be used and may be selected based on the layout, size, and loading of the deck 100 in addition to the soil conditions and other design factors.

While the foundation 102 has been described as a caisson foundation 108, other types of foundations 102 may also be provided. In some embodiments, a spread footing-type foundation may be provided. Considerations of frost protection may be included and the footing may be placed a suitable distance below grade such as, for example, 60", 48", 36", 24" or other distances as determined by local building codes. Where a spread footing is placed below grade, a concrete pier similar to the caisson 108 previously described, may be provided extending upward from the footing to a point just above grade for attachment of the frame 104. The spread footing may be sized, offset, and otherwise designed to accommodate the overturning forces induced by the frame 104 of the deck 100. Other foundations 102 may include a grade beam type foundation extending along the home or adjacent structure and having one or more frames 104 attached thereto. The grade beam may be a standalone grade beam or it may be supported by pilings, caissons, or other deep foundation type systems. The spread footing discussed above may also bear on deep foundation systems or it may bear directly on the soil at one of the depths described or at another depth. In still other embodiments, the foundation 102 may include a portion of the frame that extends into the ground. That is, a portion of the frame may be driven into the ground similar to a piling, for example, and the remaining portion of the frame may extend therefrom. Other types of foundations 102 may also be provided.

The foundation 102 may include an attachment surface 112 configured for attachment of the frame or frames 104 thereto. The attachment surface 112 may include a substantially flat surface that is at or slightly above grade. In some embodiments, the attachment surface 112 may be below grade. The attachment surface 112 may be a substantially horizontal surface for attachment of one or more frames 104 that may extend upwardly therefrom. In other embodiments, the attachment surface 112 may be a substantially vertical surface or another orientation of the surface 112 may be provided.

Depending on the nature of the frame 104 and the type of connection included for attaching to the foundation 102, the foundation 102 may also include an anchor system 114. As shown in FIG. 4, the anchor system 114 may include one or more pull-out resisting anchor bolts, rods, or other embedded elongate elements 116. The pull-out resisting anchor elements 116 may be headed anchor bolts, J-bolts, or other bolt-type anchors. Other anchor elements 116 may also be used.

The anchor elements 116 may be embedded in the concrete for an embedment distance 118 and may extend out of the foundation 102 at the attachment surface 112. The anchor elements 116 may extend out of the foundation 102 a distance sufficient to secure the frame 104 to the anchor elements 116. In one embodiment, the anchor elements 116 of the anchor system 114 may be embedded a total distance 118 ranging from approximately 4 inches to approximately 48 inches. In other embodiments, the embed length 118 may range from approximately 12 inches to approximately 36 inches. In still other embodiments, the embedment 118 may be approximately 24 inches. Other suitable embedment lengths 118 may be selected based on the loading and other conditions relating to the deck structure. For example, the more heavily tensioned anchor bolts may be embedded further than other anchor bolts to provide additional pull-out resistance or more anchor bolts may be provided to accommodate the overturning induced tension on the anchor bolts. In some embodiments, all of the anchor bolts may be embedded the same distance for simplicity, even where the compression side bolts may be sufficient with lesser embedment. The anchor elements may extend out of the attachment surface a distance ranging from approximately 1 inch to approximately 12 inches. In some embodiments, the elements 116 may extend approximately 3 inches to approximately 9 inches. In other embodiments the anchor elements 116 may extend approximately 6 inches out of the attachment surface. Other suitable extension lengths may be selected based on the type of attachment provided by the frame 104. In some embodiments, the extension may be selected to accommodate a grout thickness between the foundation and the frame of approximately 1½ inches in addition to a base plate thickness of ¾" to 1" in addition to a length for attaching a nut, for example.

Figure 6:
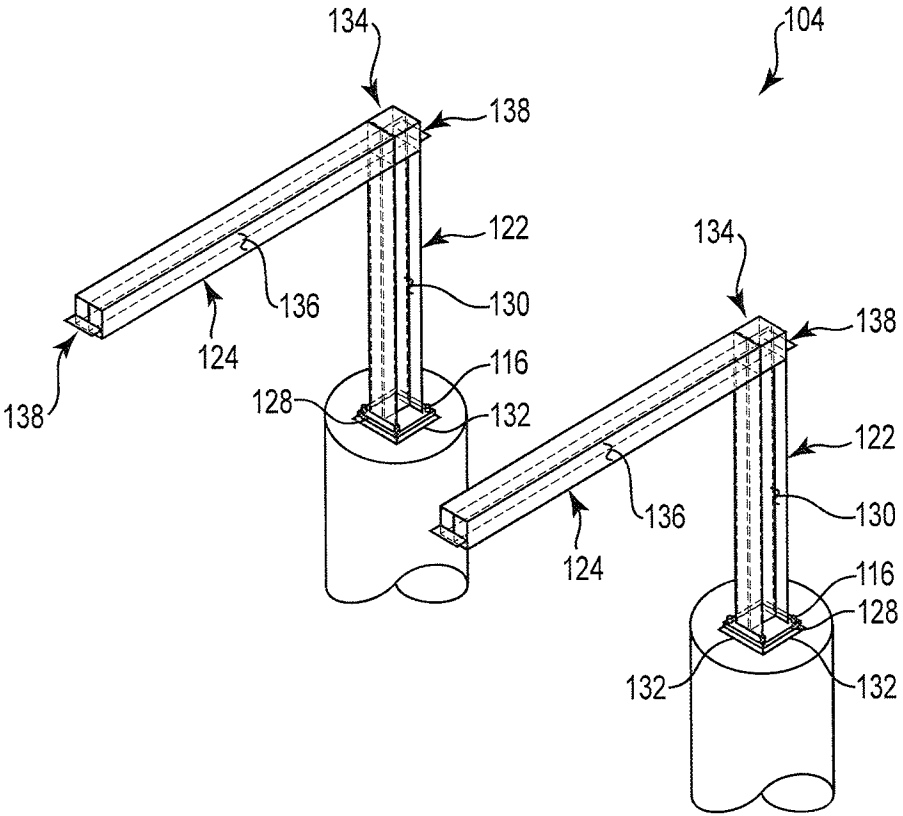
FIG. 6 is a perspective view of a pair of frames of the deck of FIG. 2.

The plan view arrangement of the anchor elements 116 may include a square arrangement, as shown in FIGS. 4 and 6. Other arrangements such as rectangular 116 or other arrangements may also be provided. Depending on the number, size, loading, and spacing of the anchors 116, additional anchor elements 116 may be provided on the side of the base plate opposite the cantilevered direction. For example, as shown in FIG. 5, four anchor elements 116 may be provided near the back edge of the base plate, while two anchor elements 116 are provided near the front edge. Other arrangements, quantities, and groupings of anchor elements 116 may be selected for suitably anchoring the base plate 128 to the foundation 102. The anchor elements 116 may be positioned within the spaces defined by the I-shaped cross-section of the column and across the back face of the column. Other arrangements can also be provided. In some embodiments, more anchor elements 116 may be provided near and around the tension flange or tension face of the column to suitably transfer the bending induced tensile forces from the tension flange into the foundation 102.

Reinforcing 110 in the foundation 102 may be adapted to develop the loads from the anchor elements 116 into the foundation 102. For example, longitudinal reinforcing 110 may be lapped with the anchor elements 116 to secure the anchor elements 116 in the foundation 102 and develop tensile forces present in the anchor elements 116. Other arrangements and methods for securing the frame 104 to the foundation 102 may also be provided. That is, while anchor elements 116, such as anchor bolts, have been described, other anchor systems 114 may be provided including embed plates having headed studs or other anchor elements 116 extending therefrom embedded in the foundation 102. Still other anchor systems 114 may be provided. The anchor system 114 together with portions of the frame 104, to be described below, may form a moment resisting connection between the frame 104 and the foundation 102.

One or more frames 104 may extend from the foundation 102 at the attachment surface 112. The frames 104 may include an offsetting portion 122 and an outlooking portion 124. The offsetting portion 122 may extend from the attachment to the foundation 102 and be configured to extend upward to define the offsetting distance, or height, between the top of the foundation 102 and the deck system 106. The outlooking portion 124 may extend from the offsetting portion 122 and be configured for attachment to and support of the deck system 106. That is, the outlooking portion 124 of the frame 104 may form a rib extending across the deck system 106 for attachment of structural beams that, in turn, support the joists of the deck as will be described in more detail below. Other framing arrangements between the deck system 106 and the frame 104 may also be provided. For example, the joists may extend substantially perpendicularly to the frames. In either case, or in still other arrangements, the frame 104 may form the main deck supporting structure that collects the loads from the deck system 106 and carries the load to the foundation 102.

The offsetting portion 122 of the frame 104 may include a base connecting element 126 and a column. The base connecting element 126 may be in the form of a base plate, a flange type element such as an angle or plate, an end cap, or other connecting element configured for attachment to the attachment surface 112 of the foundation 102. In one embodiment, as shown, the base connecting element 126 may take the form of a base plate 128 having plan view dimensions slightly larger than that of the column 130. As shown in FIG. 6, for example, the column may be approximately 14 inches by 14 inches, and the base plate 128 may be, for example, 20 inches by 20 inches. Other base plate sizes and relationships between base plates 128 and columns 130 may also be provided and selected to provide suitable anchor bolt clearance relative to the column 130, suitable distribution of forces to the foundation 102, and suitable stresses within the base plate 128. The base plate 128 may have a thickness ranging from approximately ¼ inch to approximately 3 inches. In other embodiments, the base plate 128 may have a thickness ranging from approximately ½ inch to approximately 1½ inches. In still other embodiments, the base plate 128 may be approximately 1 inch thick. The base plate 128 or other base connecting element 126 may be stiffened relative to the column with stiffener plates, angles, anchor chairs, or other stiffening elements.

The base connecting element 126 may be gapped or spaced above the foundation 102 by a grout bed 132 allowing for uniform contact between the base connecting element 126 and the foundation 102 for suitably distributing the load from the base plate 128 to the foundation 102 and also allowing for leveling of the base plate 128 and thus plumbing the column 130. The grout 132 may be placed after the column 130 is plumbed and leveled and may be a non-shrink grout. As shown, in one embodiment, the base plate 128 may have a plurality of holes for receiving the anchor elements 116 from the foundation 102. The holes may be arranged to correspond to the anchor element arrangement provided by the foundation 102. The holes may be oversized to allow for flexibility in placing the anchor elements 116. A securing set of threaded nuts may be provided for threadably receiving the anchor elements 116 and securing the base plate 128 to the foundation 102. A set of washers may also be provided. In addition, an adjusting set of threaded nuts may be provided for threadably receiving the anchor elements 116 and for placement between the base plate 128 and the foundation 102 for use in leveling the base plate 128 prior to grouting. Alternatively, shim plates or shim packs may be used to level the base plate 128 prior to grouting. Other leveling mechanisms and/or systems may also be used. The base connecting element 126 together with the anchor elements 116 embedded in the foundation 102 may form a moment resisting connection between the frame 104 and the foundation 102. In some embodiments, rather than providing anchor elements and a base plate, the column of the frame may be embedded in the foundation. That is, for example, the column may extend down into the caisson 4', 8', 12' or more and be positioned within the reinforcing cage of the caisson.

The column 130 of the offsetting portion 122 may be configured to carry the vertical loads and bending loads transferred thereto from the outlooking portion 124. It is noted that the nature of the structure may cause the cross-section of the column 130 to be relatively broad in multiple directions due to the unbraced condition near the top of the column 130 and the relatively high amount of bending in addition to vertical load being carried by the column 130. The column 130 may include an I-shaped member such as a wide flange, an H-section, or other I-shaped member. In some embodiments, for example a wide flange column such as a W14×61 or a W18×119 may be used. Other wide flange shapes or other sections may also be selected to suitably resist the loads present and/or anticipated for a deck. For example, other cross-sections of the column may include hollow sections such as tube steel (TS) sections, hollow structural sections (HSS), or other hollow tubular sections. Solid sections may also be provided. In some embodiments, filled sections may be provided. For example a hollow section filled with concrete or other material may be provided. In still other embodiments, encased sections may be provided, where, for example, an I-shaped member may be encased in a square, round, or other shaped concrete column. In any of the above-mentioned embodiments, the column 130 may be secured to the base connecting element 126 by welding, bolting, or otherwise fastening the column 130 to the base connecting element 126. In alternative embodiments, the column 130 and base connecting element 126 may be integral with one another by casting, extruding, or rolling the elements as a single element. Other column elements 130 may be provided.

The column 130 may be oriented such that, in cross-section, larger amounts of area are provided toward the face of the column 130 opposite the cantilever and toward the face of the column facing the cantilevered direction of the deck 100. That is, larger amounts of area may be provided near the back and front of the column 130 rather than along the sides of the column 130. For example, as shown, where an I-shaped column 130 is provided, the column 130 may be oriented to place the flanges of the column 130 in the front and back positions rather than along the sides of the column 130. That is, the web of the I-shaped member may align with the cantilevered direction of the deck 100. Where built up boxes or other members are used, the elements near the front and back of the column 130 may be thickened or otherwise may provide more cross-sectional area to accommodate the bending stresses in the column 130. In other embodiments, uniform thicknesses may be provided on all sides of a box or tube sections.

The outlooking portion 124 of the frame 104 may include a moment resisting connection 134 to the offsetting element 122, a beam 136, and securing features 138 configured for connection of the deck system 106 to the outlooking portion 124. The moment resisting connection 134 may be configured to allow the outlooking portion 124 to extend from the offsetting portion 122 and support the deck system 106. That is, the moment resisting connection 134 may substantially maintain the angular relationship between the outlooking portion 124 and the offsetting portion 122 and prevent substantial rotation between the outlooking portion 124 and the offsetting portion 122 at a location proximate to the connection 134.

Figure 7:
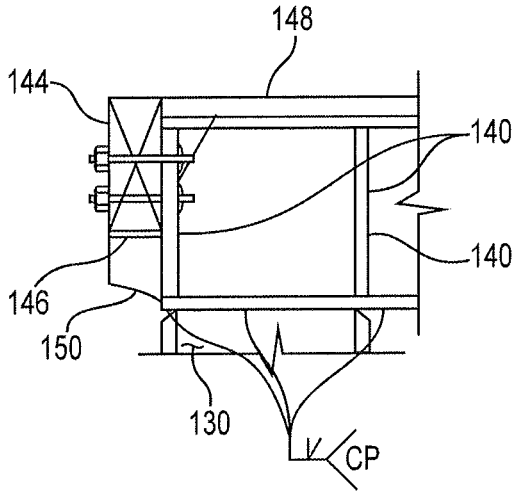
FIG. 7 is a close-up side view of the connection between an outlooking portion and offsetting portion of the frames of FIG. 6.

In one embodiment as shown in FIG. 6, the beam 136 may extend across the top of the column 130. The beam 136 may stop flush with the back side of the column 130 or the beam 136 may extend beyond the back side of the column 130 to more suitably position the interior edge of the deck 100 adjacent the structure. As shown in FIG. 7, stiffeners 140 may be included on either side of the web of the beam 136 in line with the flanges of the column 130. The ends of the flanges of the column 130 may include edge preparations and be connected to the beam with complete penetration welds as shown. The stiffeners 140 may also be welded in place with complete penetration welds to the bottom flange of the beam 136. Additional fillet welding may be provided between the stiffeners 140 and the web of the beam 136. The stiffeners 140 may have thicknesses the same or similar to the thickness of the column flange thickness. For example, the web stiffeners 140 may be approximately ⅜ inch to approximately 2 inches thick or approximately ½ inch to approximately 1½ inch thick. In other embodiments, the web stiffeners 140 may be approximately 1 inch thick. Other thicknesses of web stiffeners 140 may be selected to provide suitable load transfer in the moment resisting connection 134.

In other embodiments, the beam 136 may frame into the front face of the column 130 rather than extending across the top of the column 130. The beam 136 may be connected to the front flange of the column 130 with a welded connection or a bolted connection such as a shear tab or double angle connection. In this embodiment, the ends of the flanges of the beam 136 may include edge preparations and be connected to the face of the column 130 with complete penetration welds.

Stiffeners 140 may be provided in the web of the column 130 in line with the flanges of the beam 136 and may be welded to the front flange of the column 130 with complete penetration welds and fillet welds between the stiffeners 140 and the web of the column 130 may also be provided.

While two examples of primarily welded moment resisting connections 134 have been described, bolted moment resisting connections or combinations of bolted and welded connections may also be provided. For example, an extended end plate connection, a top and bottom angle connection, or other moment resisting connections 134 may also be provided. Where steel columns and beams are used, one of several moment resisting connections 134 recognized by the American Institute of Steel Construction (AISC) may be provided. Other moment resisting connections 134 may also be used. In still other embodiments, a knee-braced type connection may be provided where a strut is connected to the column 130 and the beam 136 and extends diagonally between the two near the intersection of the beam 136 and the column 130. In still other embodiments, the column 130 and beam 136 may be continuous with one another and the moment resisting connection 134 may be provided by the continuity therebetween. That is, a structural member such as a wide flange, a tube, or a pipe, for example, may be rolled or bent to form a frame 104 with integral offsetting 122 and outlooking portions 124 where the two portions 122, 124 are formed by different portions of the same substantially continuous structural member.

Figure 9:
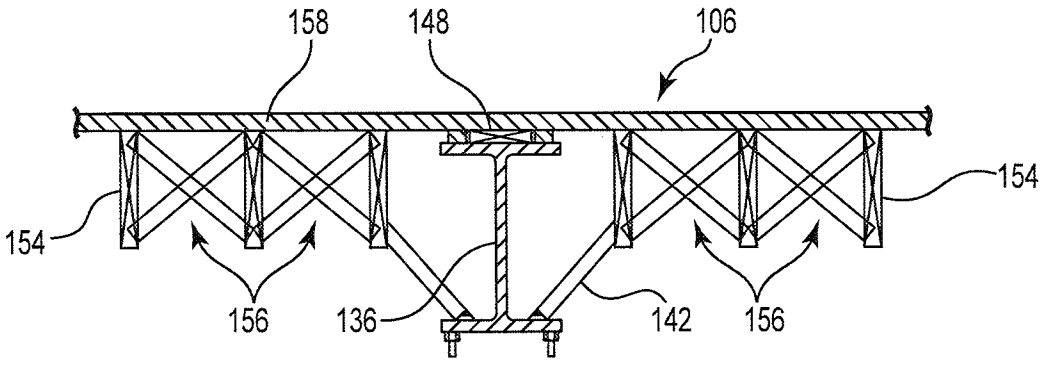
FIG. 9 is a cross-section view through the deck system and frame of the deck of FIG. 2 showing bridging and bracing thereof.

The beam 136 of the outlooking portion 124 may be configured to collect the loads from the deck system 106 and transfer them to the column 130. As such, the beam 136 may be configured to resist bending moments and shear forces induced in the beam 136 due to concentrated or distributed loads applied along its length. Like the column 130, the beam 136 may include an I-shaped member such as a wide flange, an H-section, or other I-shaped member. For example, the beam may be a W14×61 or a W18×119 for example. The beam size may correspond to the column size or differing members may be provided. Other wide flange shapes or other sections may also be selected to suitably resist the loads present and/or anticipated for a deck 100. For example, other cross-sections of the beam may include hollow sections such as tube steel (TS) sections, hollow structural sections (HSS), or other hollow tubular sections. Solid sections may also be provided. Other cross-sectional shapes may also be provided. In some embodiments, the bottom flange of the beam 136 may be braced at one or more points along the length of the beam 136 as shown in FIG. 9. The bracing 142 may allow the unbraced length of the compression flange of the beam 136 to be reduced during design thereby allowing the size of the beam 136 to be more efficient than a fully unbraced beam 136.

Figure 8:
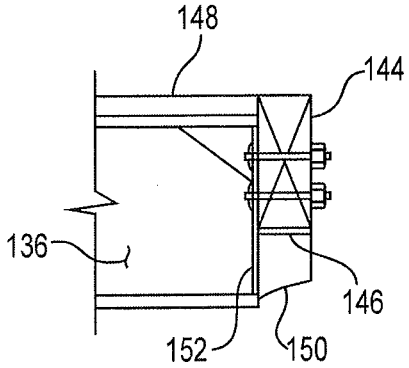
FIG. 8 is a close-up side view of the outer end of the outlooking portion of the frames of FIG. 6.

In some embodiments, as shown, the outlooking portion 124 of the frame 104 may be upset into the boundary of the deck system 106 to partially or substantially seclude the outlooking portion 124 of the frame 104. In this embodiment, as shown in FIG. 2, the deck system 106 may include a pair of structural rim joists 144 extending across the outer edge of the deck 100 and the interior edge of the deck 100. Each of the front and rear structural rim joists 144 may be supported by the respective cantilevered tip of the outlooking portion 124 and the opposite end, or heel, of the outlooking portion 124. Securing features 138 for securing the structural rim joists 144 to the outlooking portion 124 may be provided. As shown in FIGS. 7 and 8, the securing features 138 may include a stiffened seat plate 146 secured to a stiffener 140 or end plate provided at the ends of the beam 136 of the outlooking portion 124. As shown in FIG. 7, for example, at the heel end of the outlooking portion 124 where the beam 136 is connected to the column 130, a pair of stiffeners 140 may be present in the web of the beam 136 as part of the moment resisting connection 134 between the beam 136 and the column 130. Where the beam 136 stops flush with the back side of the column 130, a seat plate 146 may be provided and welded or otherwise secured to the web stiffener 140 to provide a ledge upon which to set the interior structural rim joist 144. The seat plate 146 may have a thickness ranging from approximately ⅛ inch to approximately 1½ inch or from approximately ¼ inch to approximately ¾ inch. In other embodiments, the seat plate 146 may be approximately ½ inch thick. The seat plate 146 may have a width substantially equal to the width of the rim joist 144 and a length substantially equal to the width of the beam 136. The seat plate 146 may be spaced downward from the top of the beam 136 a distance defined by the depth of the rim joist 144 less a thickness of, for example, 1½ inches to accommodate a nailer 148 that may be placed on top of the beam 136. As such, once the structural rim joist 144 is placed on the seat, the top of the rim joist 144 may be flush with the top of a nailer 148 on the beam 136. The seat 146 may be stiffened by placing a stiffener 150 below the seat 140 and welding or otherwise securing the stiffener 150 to the web stiffeners 140 in the beam 136. This seat stiffener 150 may be aligned with the web of the beam 136 to transfer the rim joist reaction forces through shear into the web of the beam 136.

Figure 3:
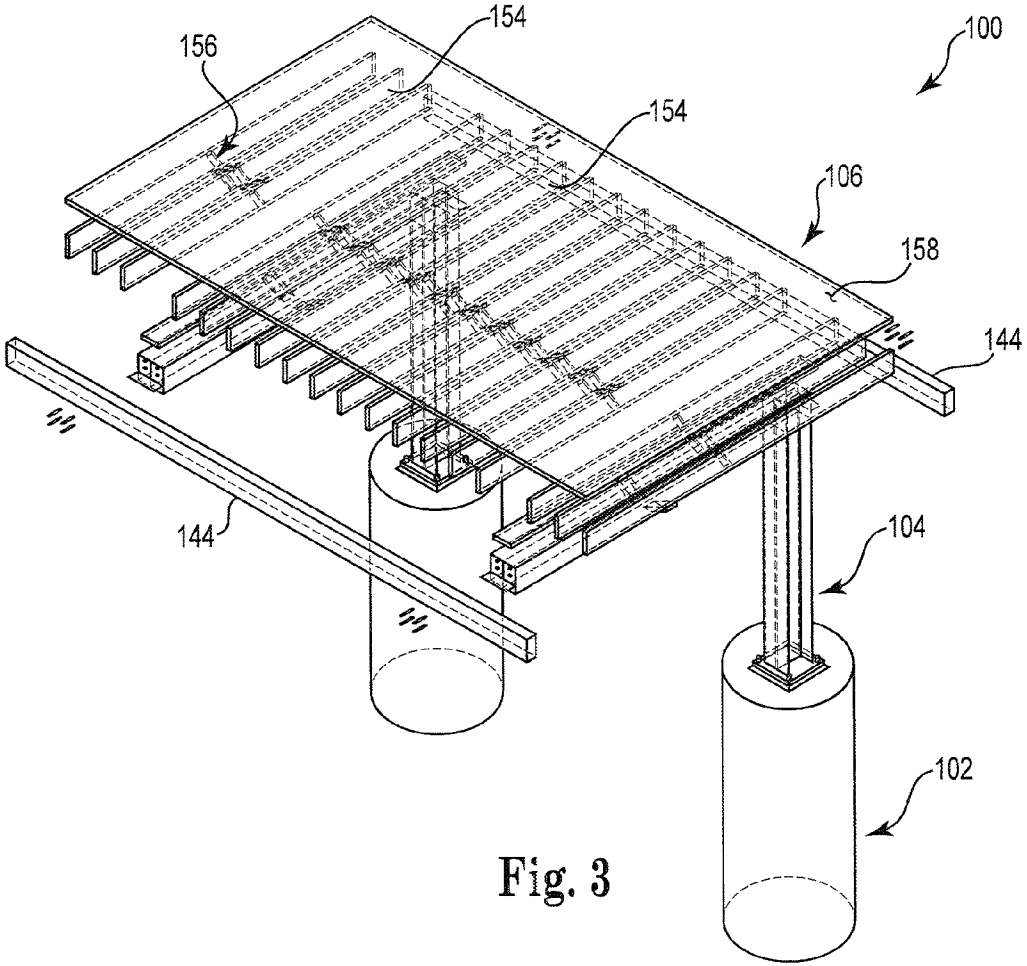
FIG. 3 is an exploded view of the deck of FIG. 2.

At the outer end of the beam 136, or at the inner end if the beam 136 extends beyond the back face of the column 130, a similar approach may be taken as shown in FIG. 8. However, stiffeners or an end plate 152 may be provided on the end of the beam 136 to provide a surface to secure the seat plate 146. The stiffeners 152 in this case may range from approximately ⅛ inch thick to approximately 1½ inch thick. In other embodiments, an approximately ¼ inch to approximately 1 inch thick or approximately ⅜" thick stiffener 152 may be used. In both the outer and interior condition, the rim joist 144 may be seated on the seat plate 146 for vertical support and may be secured to the outlooking portion 124 with a plurality of fasteners. The fasteners may include a plurality of bolts as shown in FIG. 3. The plurality of fasteners may extend through the rim joists 144 and the web stiffeners 140 or end stiffener 152 to secure the rim joists 144 to the ends of the outlooking portion 124 of the frame 104.

The frame 104, including the offsetting portion 122 and the outlooking portion 124 and the several parts thereof, may be made from steel materials. In some embodiments, the frame 104 may include an ASTM A36 steel or ASTM A572 steel material. Other steel grades may also be used. The anchor elements 116 embedded in the foundation 102 may be ASTM F1554 type anchor bolts or other types or grades of anchor bolts may also be used. Other materials for the frame 104 may also be used such as, for example, concrete, composites, or other materials.

The structural rim joists 144 mentioned may form a part of the support elements making up the deck system 106 supported by the frame 104 or frames 104. The structural rim joists 144 may include, for example, a wood beam such as a 2×6, 2×8, 2×12 or a multiple of 2× members built up to provide, for example, a (3) 2×12 beam. Other combinations of dimensioned, rough sawn, or other lumbers may also be used. In other embodiments, an engineered wood beam may be provided. For example a glue-laminated beam, parallel strand lumber (PSL), laminated veneer lumber (LVL), laminated strand lumber (LSL), or other engineered wood product may be provided. The structural rim joist size may be selected to suitably carry the loads of the deck 100 between adjacent outlooking portions 124 of the frame 104. In one embodiment, each of the outer and inner rim joists 144 may include a 5¼ inch by 11¼ inch PSL beam. Other sizes and types of rim joists 144 may also be provided and selected to suitably support the outer and inner edges of the deck system 106. In some embodiments, the structural rim joists 144 may be pressure treated, termite treated, or otherwise treated to reduce the deterioration of the elements due to exposure to weather, sun, termites, or other natural forces that can cause deterioration. Other materials for the rim joists 144 may also be used.

The structural rim joists 144 may be designed to span the distance between the frames 104 and may be continuous past the end of a frame 104. For example, where three frames 104 are provided and the frames 104 are spaced approximately 10 feet apart, a 20 foot structural rim joist may be provided and extend along all three frames 104. Additionally, as shown in FIGS. 2 and 3, the structural rim joist 144 may cantilever beyond the end of the frame 104 to provide a deck size slightly larger than the size defined by the frame spacing. Suitable cantilever lengths may be provided and may be approximately equal to ¼ to ½ or approximately ⅓ of the back span dimension. That is, if the frame spacing is approximately 9 feet, the cantilever dimension may be approximately 3 feet. Other cantilever lengths may be selected to provide a suitable deck size and to maximize the efficient use of the framing materials.

As shown in FIGS. 2 and 3, the deck support elements may also include a plurality of joists 154 spaced apart from one another and spanning between the outer and inner structural rim joists 144. The plurality of joists 154 may include lumber products such as 2×6's, 2×8's, 2×10's, 2×12's or other suitable lumber products for spanning the distance between structural rim joists 144 and supporting a specified loading. In other embodiments, engineered lumber such as those described with respect to the structural rim joists 144 may also be provided. In still other embodiments, wood I-joists may also be provided. Still other materials may also be used. The joists 154 may be spaced from one another by a distance suitable for spanning by the decking 158 placed on top of the joists. For example, the joists may be spaced at 12 inches, 16 inches, or 24 inches on center. Other spacings may also be used and the spacings may be adjusted to accommodate interruptions such as edges, the outlooking beam 136, deck joints, or other variables. The joists 154 may be secured to the structural rim joists 144 with joist hangers or another suitable connection device.

The joists and other portions of the deck structure may be selected based on loadings prescribed by local building codes or other authorities. In some embodiments, the deck elements may be designed to carry the dead load of the deck in addition to a 40 pound per square foot live load. In still other embodiments, a 50 pound per square foot live load may be used. In still other embodiments, a 100 pound per square foot live load may be used. In still other embodiments, accommodations for snow drift may be made and the loading on the deck surface may be increased near the adjacent structure and decreased moving away from the structure.

The plurality of joists 154 may be held in their spaced apart relationship with one or more rows of bridging 156 extending substantially perpendicular to the joists. As shown in FIG. 9, the bridging may include 1×3 diagonal bracing positioned at the ½ point of the joist span as shown. For longer spans, the ⅓ points or ¼ points may be used. Where the bridging intersects the beam 136 of the outlooking portion 124 of the frame 104, a 2×6 brace 142 may be provided extending from the nearest joist 154 to the bottom flange of the outlooking beam 136. The brace 142 may be secure to the bottom flange of the beam 136 with two ⅜" diameter through bolts. Other bridging sizes, bracing sizes and through bolt sizes may be selected and provided to suitably brace the joists 154 relative to one another and provide lateral bracing to the beam bottom flange.

As shown in FIG. 9, a nailer 148 may be provided on the top surface of the beam 136 of the outlooking portion 124 of the frame 104. The nailer 148 may be a 2× member such as a 2×6, a 2×8, a 2×12, or a 2×10 as shown. The nailer 148 may be configured to support the decking 158 at the beam 136 location and provide a nailable surface for nailing, screwing, or otherwise fastening the decking 158 material. The nailer 148 may be fastened to the beam with 2 bolts every 24 inches on center. The bolts may be provided in the top of the nailer 148 and countersunk or counterbored to sink the head of the bolt in the nailer 148 and provide a smooth surface for the decking 158. In other embodiments, lag screws may be inserted from the bottom side and into the bottom of the nailer 148. Other sizes and spacings of fasteners may be selected to suitably secure the nailer 148 to the beam 136 of the frame 104.

The deck surface may be provided by a decking material 158 including a 2× wood decking material, a 5/4 wood decking material, a composite decking material, or an aluminum decking material. Other decking materials may also be provided and selected based on design choices, joist spacing, and other factors. The decking 158 may be nominally approximately 2 inches to approximately 10 inches wide or it may be approximately 4 inches to approximately 8 inches wide. In still other embodiments, the decking 158 may be nominally approximately 6 inches wide. Other decking widths and combinations of decking widths may also be provided. The decking may be arranged generally perpendicularly to the joist span direction or other arrangements such as diagonal or other sculpted arrangements may be used. The decking material 158 may be secured to the joists 154 with nails, screws, clips, or other fasteners or systems.

A railing system may be provide on the deck 100 to prevent users or items on the deck 100 from falling off of the edges of the deck 100. The railing may include upright posts spaced approximately 2 feet to approximately 10 feet apart or from approximately 4 feet to approximately 8 feet apart. In some embodiments, the upright posts may be approximately 6 feet apart. An upper rail and bottom rail may be provided with spindles extending vertically therebetween. The spindles may be spaced from one another such that the spacing therebetween does not exceed 4 inches. Other railing arrangements including spindle spacing may be selected to provide a suitable railing system. 100

The deck 100 may be positioned adjacent a home, building, or other structure. For example, the foundation 106 may be installed adjacent the foundation of the structure. The frame 104 may be placed on the foundation 102 and the deck system 106 may be connected to the frame 104. The foundation 102 and frame 104 may be placed such that the inner structural rim joist 144 attached to the frame 104 is positioned within inches or fractions of an inch from the structure. As such, the gap potentially present between the surface of the deck 100 and a floor system of an adjacent structure may be relatively small. In some embodiments, the gap between an adjacent floor or door threshold of an adjacent structure and the inner face of the deck system 106 may be, for example, ¼ inch, or ½ inch, or 1 inch. Other gap distances may be provided and in alternative embodiments, the deck 100 may be placed farther distances from the structure. As shown in FIG. 4, where additional space is needed to construct the foundation 102 or to provide clearances around the offsetting portion 122 of the frame 104 and where these clearances cause the gap to be unsuitably large, the outlooking portion 124 of the frame 104 may extend across the offsetting portion 122 to approach the adjacent structure and allow for suitable positioning of the inner structural rim joist 144. It is noted, that in conditions where the outlooking portion 124 extends from the outer face of the offsetting portion 122 rather than extending across the top of the offsetting portion 122, an additional inlooking portion may be connected to the inner face of the offsetting portion 122 to extend more proximate to the adjacent structure.

The deck 100 disclosed herein may thus be used in the same or similar way to current decks, balconies, perches, and other platforms. The deck 100 may be constructed during the construction of the adjacent structure or at a later time without invasively adjusting the exterior finish system of the structure. The size of the deck 100 may cover a wide range of shapes and sizes. For example, the deck 100 may extend away from a structure a distance ranging from approximately 1 foot to approximately 40 feet. In other embodiments, the distance may range from approximately 3 or 4 feet to approximately 20 feet. In other embodiments, the distance may range from approximately 10 feet to approximately 16 feet. These distances may be accommodated by adjusting the sizes of the foundation 102, frame 104, and deck system 106. For example, a deck 100 that cantilevers 20 feet may include a nominally 18 inch deep wide flange for the column 130 and beam members 136 of the frame 104 and a deck 100 that cantilevers 14 feet may include a nominally 14 inch deep wide flange for the column 130 and beam members 136. The length of the deck 100 transverse to the cantilevered direction may range from approximately 1' to several hundred feet. That is, most any length of deck may be provided by providing additional foundation 102 and frame 104 and constructing a deck system 106 corresponding to the plurality of frames 104. In some embodiments, a very short deck such as a 3' or 4' long deck may require only one frame 104. That is, a deck 100 that functions like a catwalk that extends 10 to 14 feet away from a structure, for example, but is relatively short in the orthogonal direction (i.e., 3 to 4 feet) may be constructed with a single frame 104. Where longer lengths of deck 100 are provided, multiple frames may be provided and may be spaced from one another suitably to support the deck system 106. For example, the frames 104 may be spaced from one another a distance ranging from approximately 6 or 8 feet to approximately 30 feet. In other embodiments, the frames 104 may be spaced from one another by a distance of approximately 10 feet to approximately 20 feet. In still other embodiments, the frames 104 may be spaced approximately 15 feet. Other spacings and arrangements of the deck 100 may be provided including spacing and distances outside the ranges provided to provide a suitable deck structure.

It is noted that while the current embodiment has been described with the outlooking beams 136 of the frame upset in the deck system 106 and structural rim joists 144 spanning along the outer and inner edges of the deck 100 between the outlooking beams 136, other framing arrangements may also be provided. For example, in another embodiment of an upset frame, the plurality of joists 154 may extend in an orthogonal direction to the embodiment described and frame into the side of the beam 136 of the outlooking portion 124 of the frame 104. For example, the gap adjacent the I-shaped web of the beam 136 may be filled with a lumber material by bolting through the web of the beam 136. The joists 154 may be secured to the fill with face mount hangers, for example. Alternatively, a top mount hanger may be provided to hang the joists 154 from the nailer 148 on the top of the beam 136 and the fill may be provided to brace the hanger against swaying beyond the boundary of the beam. In this embodiment, a frame 104 and corresponding outlooking portion 124 may be arranged at each end of the deck system 106 and may be clad in wood or other members to further seclude the frame 104 from view.

In still other embodiments, the outlooking beam 136 of the frame 104 may not be upset in the boundary of the deck framing system 106 and the deck system 106 may be assembled and arranged to rest, for example, on the top of the outlooking portion 124 of the frame 104 or a nailer 148 positioned thereon. In this embodiment, for example, structural rim joists 144 may be provided as before, but they may rest on the top of the beam 136 of the outlooking portion 124 of the frame 104 rather than framing along the inner and outer end of the beam 136. The plurality of joists 154 in this embodiment may span between the structural rim joists 144 as before.

In still other embodiments, where the beam 136 of the frame 104 is not upset in the boundary of the deck framing system 106, the plurality of the joists 154 may be arranged perpendicular to the outlooking beam 136 of the frame 104 and may rest on the surface of the beam 136 or a nailer 148 positioned thereon. The joists 154 may stop at the beam 136 or cantilever beyond the beam 136 to provide a slightly larger deck than provided by the frame spacing.

In still other embodiments, the plurality of joists 154 may be supported by a ledger board secured to the adjacent structure and supported by the rim joist at the outer edge of the deck away from the structure. In some embodiments, the connection of the plurality of joists to the ledger board may include a horizontal slide connection allowing lateral motion of the deck structure without placing tension on the ledger board.

The present disclosure may be advantageous for several reasons. That is, for example, the caisson type foundation 102 may allow for the deck 100 to be constructed adjacent an existing structure while having little impact on the structure. That is, when compared to driving piling where vibration can be a concern, the drilling process of constructing a caisson foundation may have a lesser affect on the existing structure. When compared to excavating deep holes adjacent a structure, for a spread footing for example, cribbing, shoring, or other retention systems may be required. The caisson type foundation may, thus, be further advantageous by avoiding the need for these retention systems. Still further, the caisson type foundation may be advantageous due to its ability to be constructed more proximate to an adjacent structure than, for example, a spread type footing. That is, while a spread footing may be able to be constructed adjacent to a structure, the nature of load distribution of a spread footing may be such that the center of the offsetting portion 122 of the frame 104 may be positioned away from the inner most edge of the footing causing the frame 104 to be further spaced away from the structure than with the caisson foundation. Still further, the foundation may be constructed relatively deep in the ground to engage the soil to assist in resisting the relatively high overturning forces on the foundation. Where the depth of the deck foundation is below the foundation of the adjacent structure, the construction of the deck foundation may lead to undermining of the adjacent structure foundation. This may make a spread footing foundation difficult to construct where the caisson foundation may have less of an impact on the adjacent structure foundation. That is, the length of the caisson hole along the adjacent structure may be less than the length of an excavation required for a spread footing. Moreover, casings may be used when drilling the caisson foundation to reduce or eliminate undermining of the adjacent structure.

It is noted that, in some embodiments, the foundation may be constructed integral with the foundation of the adjacent structure. For example, in anticipation of a later or concurrently constructed deck, the foundation of the adjacent structure may include bumped out portions including, for example, a bumped out footing and a bumped out pier. Anchor bolts or other anchor systems may be installed in the foundation in anticipation of deck construction. In some embodiments, sleeves may be provided in the foundation for later receiving the anchors for the deck. The sleeves may be threaded, corrugated, or smooth sleeves or another type of sleeve may be used. The later installed anchor bolts may be secured in the sleeves with epoxy, concrete, or otherwise secured in the sleeves to support the deck. In still other embodiments, the pre-constructed foundation may stop below the ground and reinforcing may be left extending from the foundation for later construction of a concrete cap for receiving the anchor bolts or other anchors for the deck structure.

In still other embodiments, embed plates, anchors, or other elements may be positioned in a concrete or other wall for later or concurrent attachment of an outlooking portion of the frame of the cantilevered deck. In this embodiment, the portion of the wall below the embed plates may form the offsetting portion of the frame and the foundation of the wall may form the foundation of the deck. In still other embodiments, the offsetting portion of the deck structure may be buried in an exterior wall of a building for later or concurrent attachment of the outlooking portion. For example the steel offsetting portion or column may be secured to the top of a foundation wall of a home and a wood framed wall may be framed around the column. An aperture in the wall may be formed for insertion of the outlooking portion for connection to the column. Other approaches to providing an aftermarket deck or concurrently built deck may also be used and some or all of the deck may be constructed concurrently with the adjacent structure or at a later time.

The present disclosure may also be advantageous due to the use of a steel structure to form a portion of the deck 100. That is, a stronger material such as steel has been strategically utilized to supplement the more common wood material used in deck constructions. For example, while constructing all of the deck 100 out of steel may be expensive, the present disclosure may take advantage of the relatively high strength of steel to form relatively cost effective frames to resist high loadings and may take advantage of the relatively low cost lumber and other decking materials for other portions of the construction. As such, an improved yet cost effective residential-type deck assembly may be provided. That is, while similar products may be used to construct a commercial-type deck, a residential-type deck may include wood products for the plurality of joists, rim joists, and/or beams and decking products including wood, composites, aluminum, or other materials. The residential-type deck assembly may be supplemented with relatively small amounts of structural steel to provide a new and improved deck structure.

Still further, the present disclosure is advantageous due to the unique aesthetics provided by the deck, the avoidance of moisture intrusion issues commonly found around ledger boards of decks, and the avoidance of obstructing columns below the far end of the deck. As such, the deck may be architecturally appealing, it may be safer or last longer than current deck systems, and may allow for unobstructed use of the space below the deck.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular embodiments. Functionality may be separated or combined in blocks differently in various embodiments of the disclosure or described with different terminology. These and other variations, modifications, additions, and improvements may fall within the scope of the disclosure as defined in the claims that follow.

The invention claimed is:

1. A deck, comprising:

a portion of a floor system in a structure;

a foundation positioned immediately adjacent to the structure;

a cantilever frame extending from the foundation and having a first moment resisting connection to the foundation, the frame including an offsetting column portion arranged substantially adjacent to the structure and extending from the foundation upwardly along the structure to a height approximating the height of the floor system and an outlooking beam portion secured to the offsetting column portion and extending away from the offsetting column portion and the structure in a cantilevered manner, the frame having a second moment resisting connection between the offsetting column and outlooking beam portions; and a deck system arranged about and supported by the frame, the deck system having a first rim joist and a second rim joist each secured to the frame and arranged at opposite ends of the outlooking beam and generally perpendicular to the outlooking beam, a plurality of floor joists having a depth and being arranged in spaced apart relationship, spanning from the first rim joist to the second rim joist, arranged substantially parallel to the outlooking beam, and positioned substantially in-plane with the first and second rim joists, and decking forming a support surface and being supported by the plurality of floor joists and arranged substantially transversely to the plurality of floor joists;

wherein:

the frame and the deck system are sized, positioned, and oriented such that the decking is positioned generally flush with the floor system of the structure with a relatively small gap between the decking and the floor system; and the outlooking beam of the frame is upset in the deck system for partial concealment, such that the top flange of the outlooking beam is positioned within the depth of the rim joists and the plurality of floor joists of the deck system.

2. The deck of claim 1, wherein the offsetting column portion is made from a first material comprising one of steel and concrete.

3. The deck of claim 2, wherein the outlooking beam portion is made from the first material.

4. The deck of claim 3, wherein the first material is steel.

5. The deck of claim 4, wherein the first moment resisting connection includes a base plate and pull-out resisting anchor bolts securing the base plate to the foundation.

6. The deck of claim 5, wherein the second moment resisting connection includes a welded connection.

7. The deck of claim 5, wherein the second moment resisting connection includes a braced connection.

8. The deck of claim 2, wherein the deck system is made from a second material different from the first material.

9. The deck of claim 8, wherein the second material comprises wood.

10. The deck of claim 9, wherein the second material comprises one of wood, composite materials, and both wood and composite materials.

11. The deck of claim 1, wherein the offsetting column portion is arranged substantially plumb on the foundation.

12. The deck of claim 11, wherein the outlooking beam portion is secured substantially perpendicularly to the offsetting column portion.

13. The deck of claim 12, wherein the outlooking beam portion is arranged to cantilever away from the offsetting column portion with substantially no moment-resisting backspan.

14. The deck of claim 12, wherein the second moment resisting connection includes a braced connection.

15. The deck of claim 12, wherein the second moment resisting connection includes a welded connection.

16. The deck of claim 15, wherein the first moment resisting connection includes a base plate and pull-out resisting anchor bolts securing the base plate to the foundation.

17. The deck of claim 16, wherein the foundation includes a spread footing.

18. The deck of claim 16, wherein the foundation includes a caisson.

19. The deck of claim 12, wherein the outlooking beam portion includes first and second ends and the first and second rim joists are secured to respective first and second ends of the outlooking beam portion.

20. The deck of claim 19, wherein the first and second ends of the outlooking beam portion each include a seat plate and the rim joists bear on the seat plates.

* * * * *